US005713758A

United States Patent [19]

Goodin et al.

[11] Patent Number: 5,713,758

[45] Date of Patent: Feb. 3, 1998

[54] CORDLOCK RETENTION

[75] Inventors: John W. Goodin, Coto de Caza, Calif.; Mark W. Le Beau, Logan, Utah; James D. Marshall, Brockville; James Schmidt, Whitby, both of Canada

[73] Assignee: Black & Decker Inc., Newark, Del.

[21] Appl. No.: 691,749

[22] Filed: Aug. 1, 1996

Related U.S. Application Data

[63] Continuation of Ser. No. 632,023, Apr. 15, 1996.

[51] Int. Cl.[6] ..... H01R 13/58

[52] U.S. Cl. ..... 439/459; 439/501; 451/357; 451/359

[58] Field of Search ..... 439/372, 467, 439/465, 459, 456, 577, 501, 457, 458; 451/357, 359

[56] References Cited

U.S. PATENT DOCUMENTS

| | | | |
|---|---|---|---|
| 2,544,343 | 3/1951 | Miller . | |
| 3,621,423 | 11/1971 | Swope | 335/290 |
| 3,775,729 | 11/1973 | Casper | 174/67 |
| 3,784,961 | 1/1974 | Gartland, Jr. | 439/465 |
| 3,810,075 | 5/1974 | Turner . | |
| 3,858,160 | 12/1974 | Denton . | |
| 4,195,194 | 3/1980 | Kuster et al. . | |
| 4,444,449 | 4/1984 | Aysta et al. . | |
| 4,734,055 | 3/1988 | Misu | 439/456 |
| 4,759,723 | 7/1988 | Siemon | 439/409 |
| 4,875,879 | 10/1989 | Bunyea et al. | 439/501 |
| 5,006,960 | 4/1991 | Kallin et al. | 439/459 |
| 5,234,358 | 8/1993 | Polgar | 439/465 |
| 5,392,568 | 2/1995 | Howard, Jr. et al. | 451/357 |

FOREIGN PATENT DOCUMENTS

| | | | |
|---|---|---|---|
| 2382882 | 10/1978 | France . | |
| 2307288 | 8/1974 | Germany | 439/465 |
| 7409034 | 1/1976 | Netherlands | 439/465 |
| 2069254 | 8/1981 | United Kingdom | 439/459 |
| 2097247 | 11/1982 | United Kingdom . | |

*Primary Examiner*—Gary F. Paumen
*Attorney, Agent, or Firm*—Bruce S. Shapiro; Dennis A. Dearing; John D. Del Ponti

[57] ABSTRACT

The invention is directed to a cordlock retention mechanism for a power tool such as an automotive polisher. The housing includes a pair of electrical contact blades which may be plugged into an extension cord. The retention mechanism includes a lower stationary latch extending from the polisher housing and an upper latch which is pivotably mounted on the housing above the lower latch. The upper latch may be pivoted between an upper position in which it is out of contact with the lower latch to thereby allow access to the blades and a lower position where it is in contact with the lower latch to enclose a space. The lower latch includes a plurality of upwardly extending off-set ribs. The upper latch includes a downwardly extending transverse vertical plate which is disposed in front of the offset ribs when the upper latch is pivoted to the closed position. In order to provide electrical power to the polisher, the plug of the extension cord receives the blades and is disposed within the enclosed space. The upper latch is pivoted to the closed position and the vertical plate is positioned directly behind the rear of the plug to preclude the plug from being disconnected from the blades. The extension power cord is threaded through the offset ribs, with the ribs forcing the plug to assume a serpentine shape.

8 Claims, 8 Drawing Sheets

CORDLOCK RETENTION

CROSS-REFERENCE RELATED APPLICATION

This application is a continuation of application Ser. No. 08/632,023, filed Apr. 15, 1996.

BACKGROUND OF THE INVENTION

1. Field of the Invention

The invention is directed to a polisher, for example, an automotive polisher having a random orbital drive.

2. Description of the Prior Art

Automotive polishers are known in the art and generally include a vertically oriented motor drive system disposed within a housing. A circular platen made of a relatively hard plastic material extends below the housing and is secured on an output shaft or pin of the drive system. A polishing pad made of softer material is secured upon the platen, and a polishing bonnet made of a cloth material is disposed about the pad. The motor drive system drives the platen and thus the pad and bonnet disposed thereon, for example in a rotary, pure orbital or random orbital manner. The driven bonnet is applied against a surface of the automobile to apply or remove wax, or to buff the surface. Similar devices such as sanders also are known and include a housing and drive system. Though sanders may be driven in a similar manner, they generally include a piece of abrasive material removably secured directly to the platen for abrading or sanding the surface of a piece of wood.

It is known, in general, to manufacture power tools having a detachable AC power cord which is plugged into the tool housing. The power cord may comprise a standard electrical extension cord which mates with conducting blades extending from the tool housing. However, such cords may become unintentionally detached during use, especially when they are pulled to the maximum extent. The resultant work interruption is undesirable.

SUMMARY OF THE INVENTION

Accordingly, it is an object of the invention to construct a power tool, for example a polisher or sander, making use of a detachable extension cord in which the tendency of the cord to be pulled out of the tool during use and thereby interrupt work is reduced.

The present invention is directed to a cordlock retention for a power tool having a housing. The housing includes a plurality of electrical contact blades. The cordlock retention includes first and second latches disposed opposite each other, with the first latch pivotably mounted relative to the second latch. The pivotable latch is movable between a closed position where it is in contact with the second latch to thereby form an enclosed space having a longitudinal axis, and an open position in which the pivotable latch is not in contact with the second latch. The contact blades are disposed within the enclosed space. A cord opening is formed in the retention when the first latch contacts the second latch; First and second offset ribs are disposed inwardly of one of the latches in a spaced relationship along the longitudinal axis. The first rib has an inner surface which extends closer to the longitudinal axis than the inner surface of the second rib. A transverse plate is formed on and extends inwardly from one of the latches, transversely to the longitudinal axis. The plate is disposed in a spaced relationship from the ribs along the longitudinal axis and has a cutout region. A power cord having a plug may be disposed within the enclosed space with the contact blades disposed within the plug at one end of the plug and the opposite end of the plug disposed forwardly of the plate. The cord passes through the cutout region and between the offset ribs whereby the ribs force the cord to bend in a serpentine manner. The cord exits the enclosed space through the cord opening

DETAILED DESCRIPTION OF THE PREFERRED EMBODIMENT

Figure 1A:
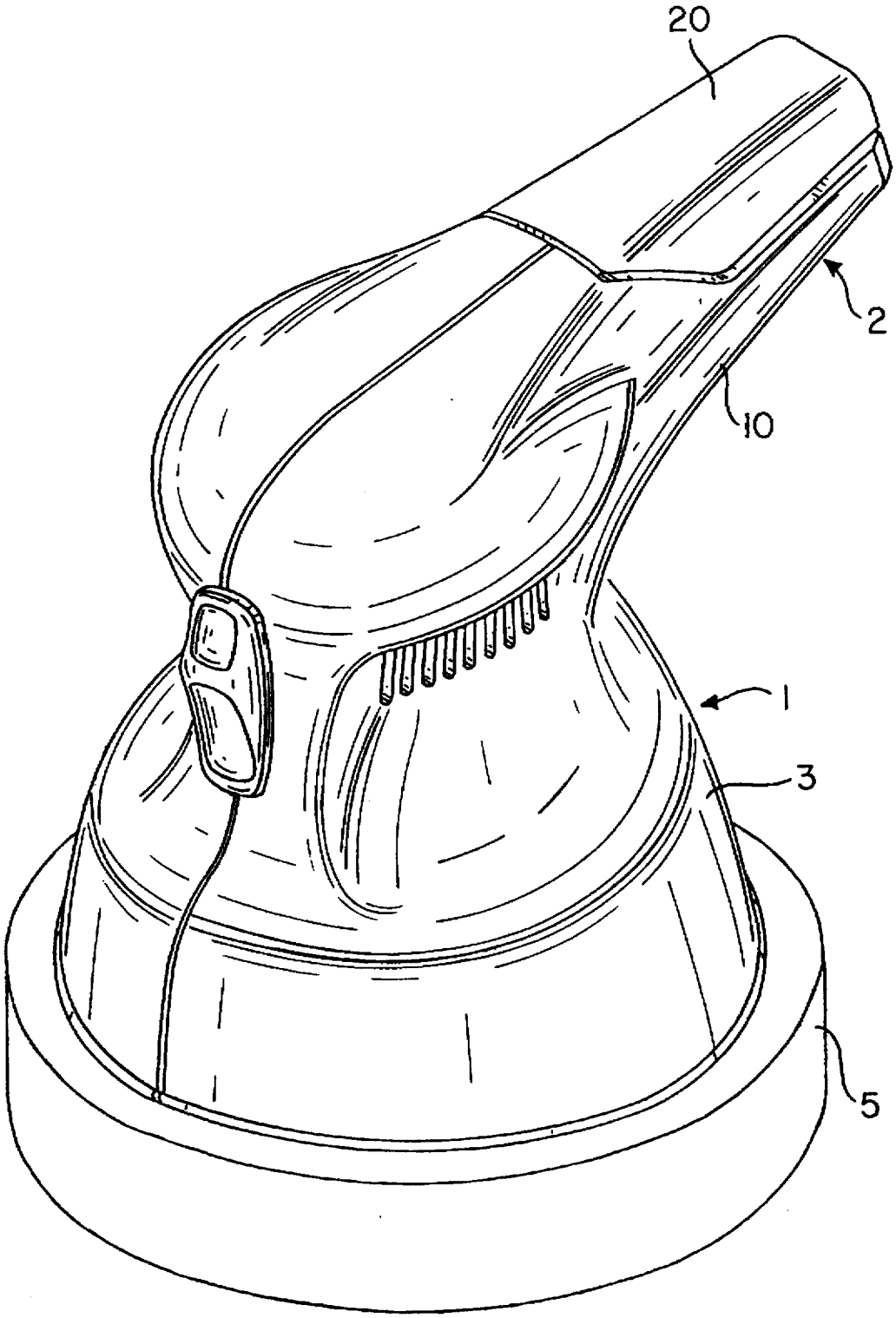
FIG. 1A is a perspective view of a polisher according to the present invention.
Figure 1B:
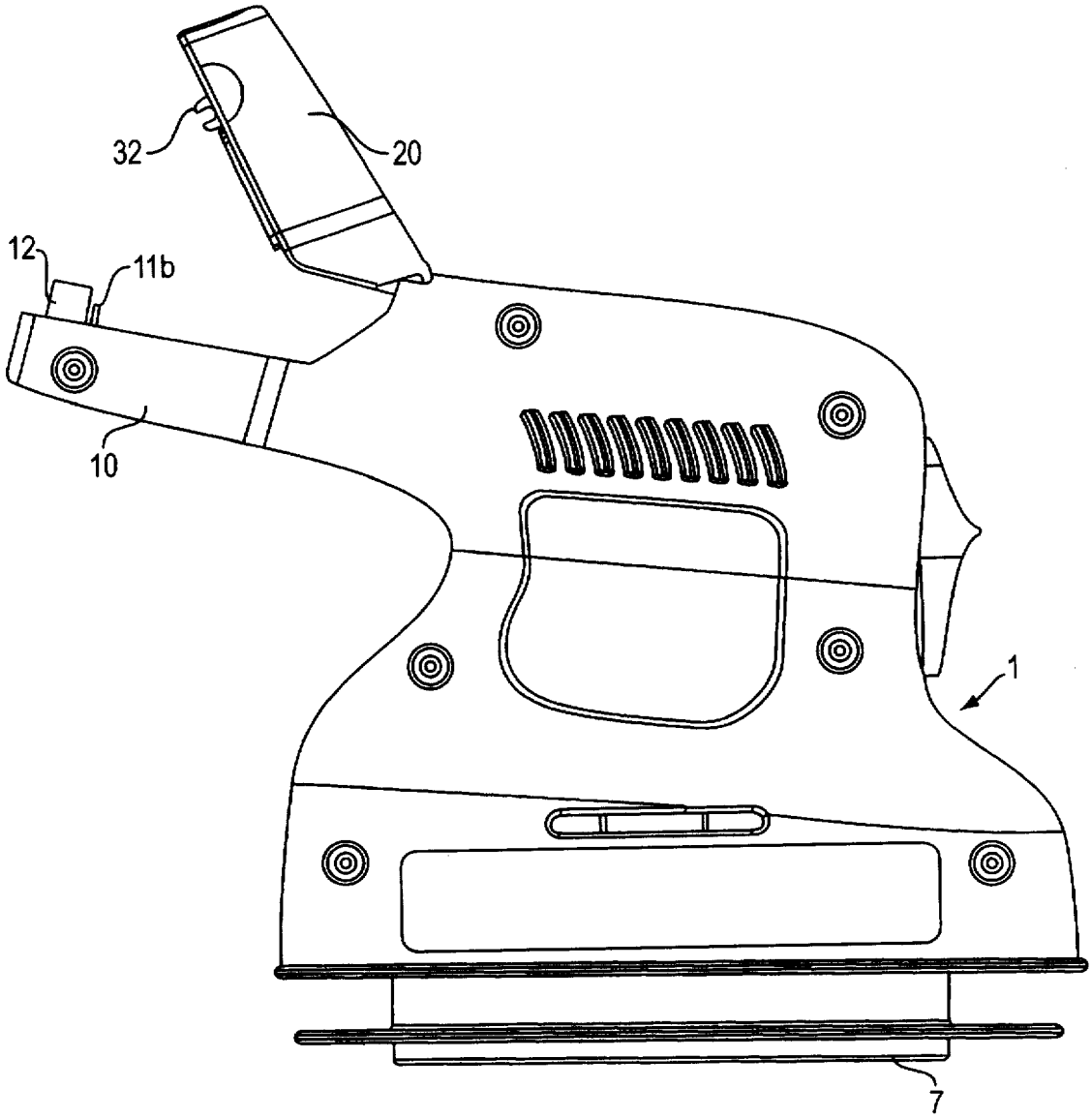
FIG. 1B is a side elevational view of the polisher shown in FIG. 1A.
Figure 1C:
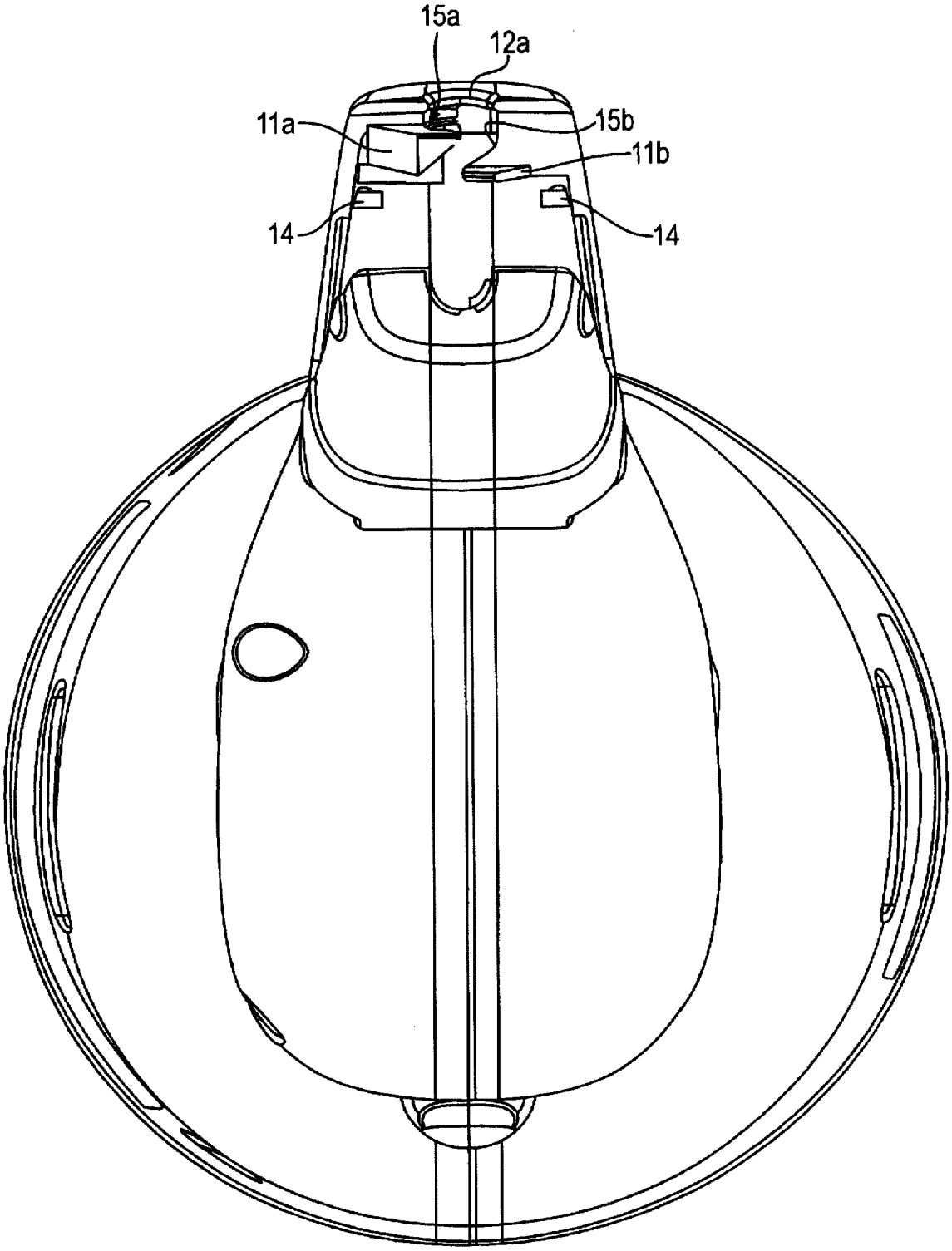
FIG. 1C is an overhead view of the polisher shown in FIGS. 1A–B
Figure 2:
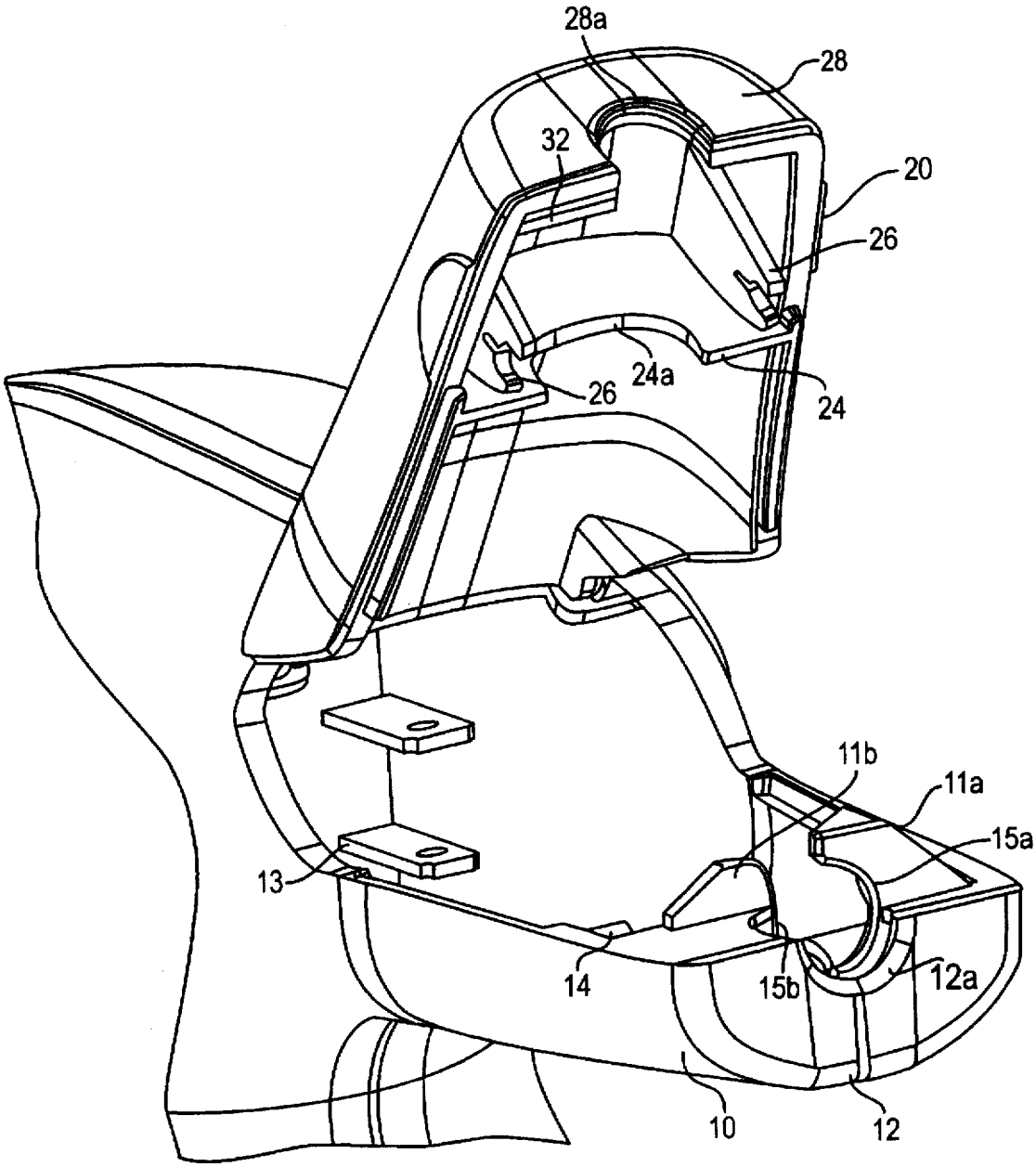
FIG. 2 is partial rear perspective view of the polisher of FIGS. 1A–C showing the cordlock retention element in the open position.
Figure 3:
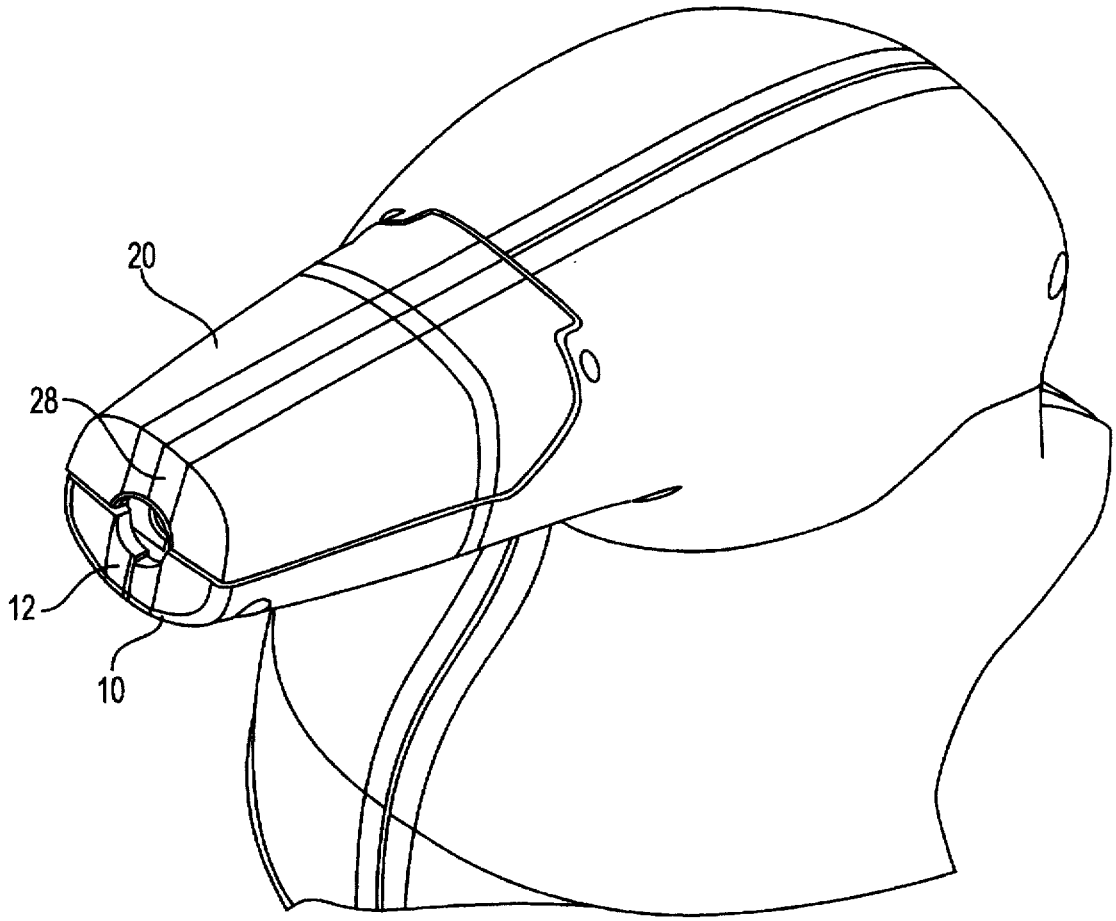
FIG. 3 is a partial rear perspective view of the polisher shown in FIG. 2 showing the cordlock retention element in the closed position.
Figure 4A:
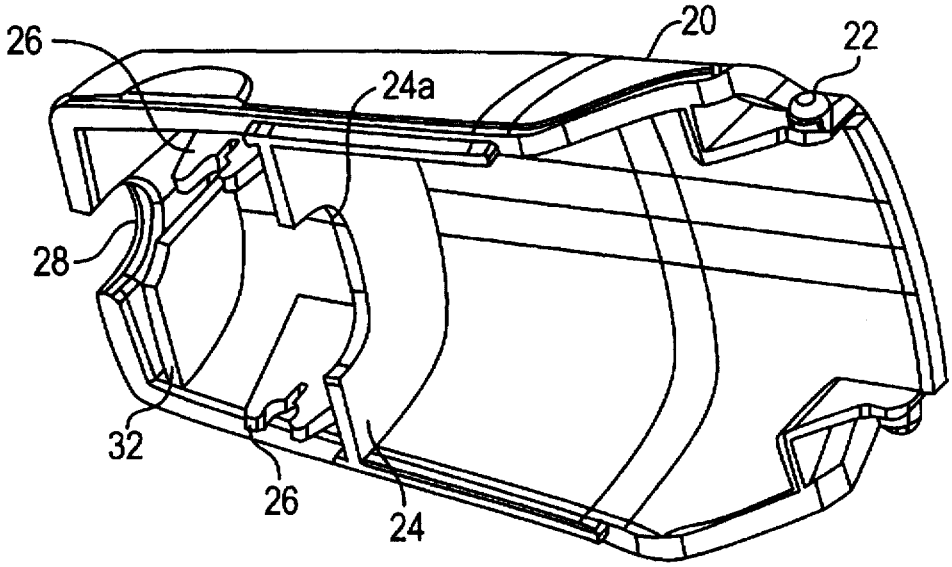
FIG. 4A is an underside perspective view of the upper pivotable latch of the cordlock retention element shown in FIGS. 1–3.
Figure 4B:
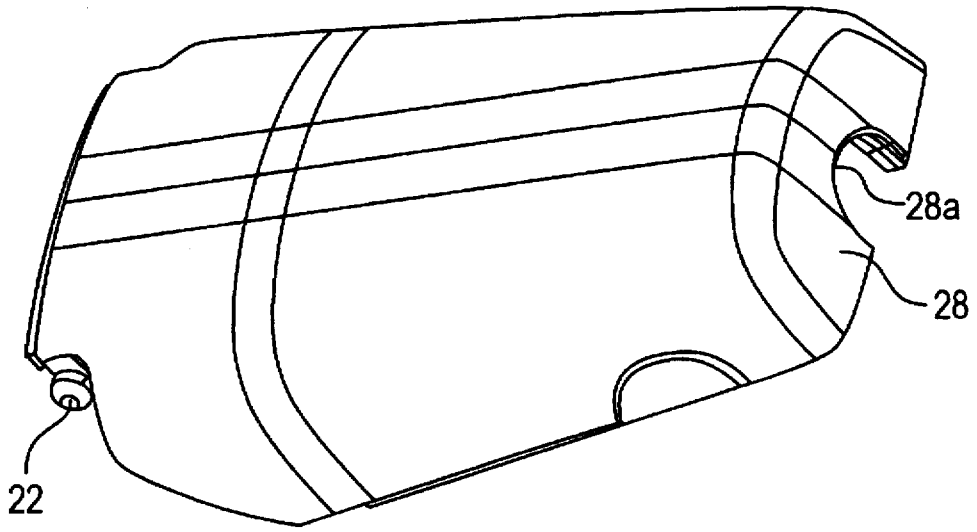
FIG. 4B is a side perspective view of the upper pivotable latch of the cordlock retention element shown in FIG. 4A.
Figure 4C:
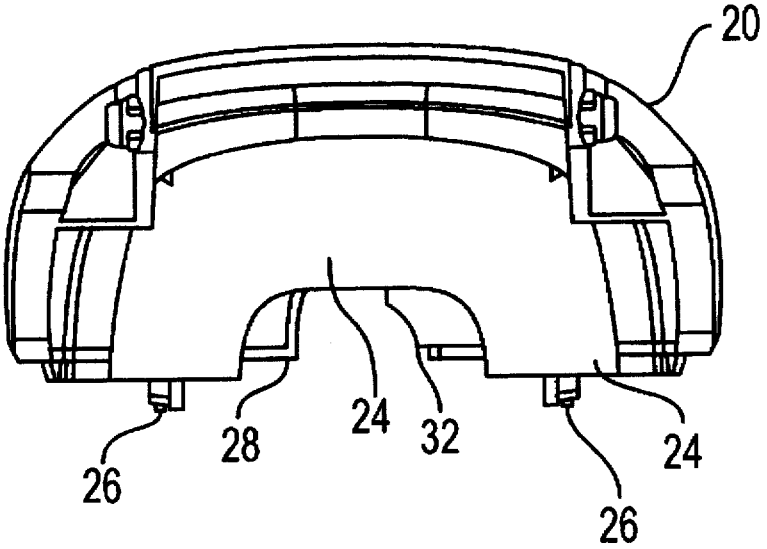
FIG. 4C is a front elevational view of the upper pivotable latch of the cordlock retention element shown in FIG. 4A.
Figure 4D:
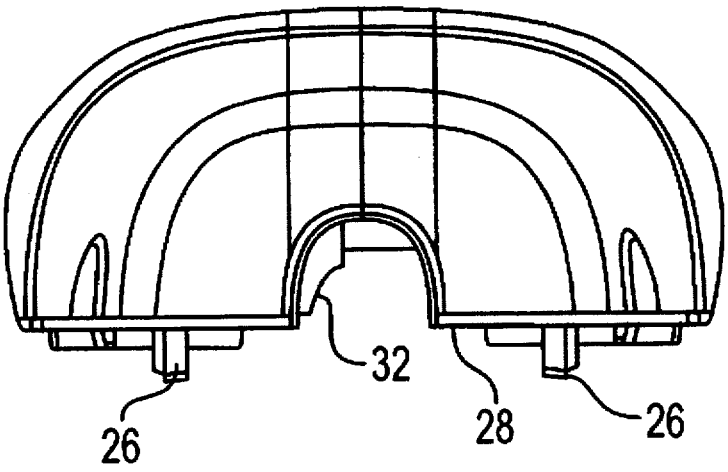
FIG. 4D is a rear elevational view of the upper pivotable latch of the cordlock retention element shown in FIG. 4A.
Figure 5:
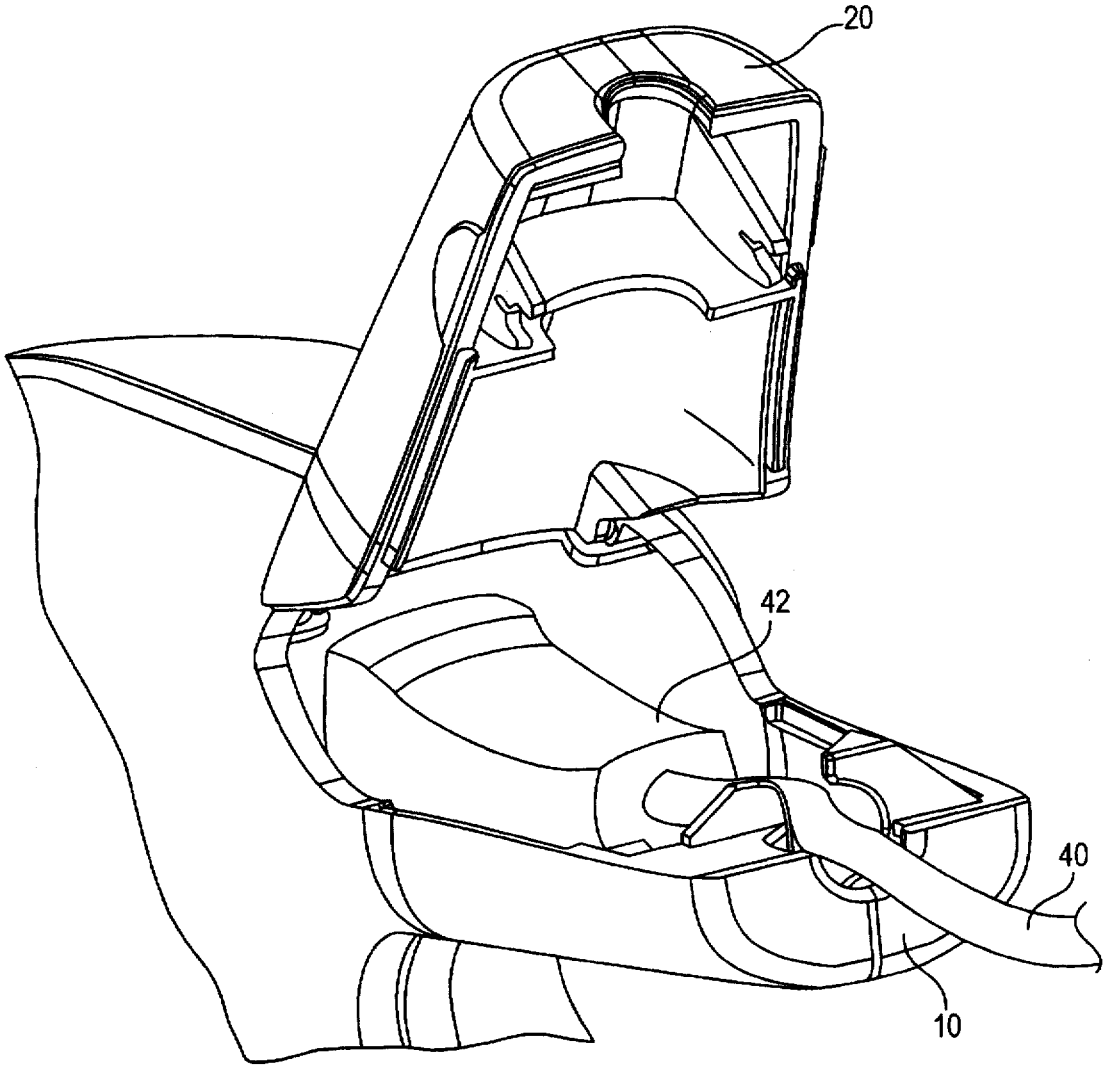
FIG. 5 is perspective view of the polisher shown in FIG. 1 with a cord inserted in the cordlock retention element.

With reference to FIGS. 1A and 1B, automotive polisher 1 includes housing 3 enclosing a conventional drive mechanism (not shown). Platen 7 extends downwardly from housing 7 and is made from a relatively hard substance such as plastic. Polishing pad 5 is secured about platen 7 and is made from a relatively soft substance such as sponge rubber. The drive mechanism drives the platen and pad in a conventional manner, for example, the pad and platen may undergo rotational, orbital or random orbital motion. A conventional cloth bonnet, not shown, would be secured about the pad. The drive mechanism, and the manner in which the platen is attached to the drive mechanism are both conventional and do not form part of this invention. For example, the drive mechanism and manner in which the platen is secured to the output of the drive mechanism could be as shown in U.S. Pat. No. 5,392,568 to Howard, Jr. et al, incorporated by reference into the present specification. In Howard, the platen of a sander is driven in random orbital motion. Furthermore, the manner in which the pad is secured to the platen also does not form part of this invention.

Polisher 1 further includes cordlock retention element 2 which includes lower stationary latch 10 and upper pivoting latch 20, both of which extend rearwardly from the upper portion of housing 3. Lower latch 10 is formed integrally with the remainder of housing 3 and has a generally semi-circular cross-section. Rearward end wall 12 of latch 10 has semi-circular opening 12*a*. Forward of wall 12, latch 10 includes upwardly extending offset ribs 11*a* and 11*b*. Ribs 11*a* and 11*b* are disposed on opposite sides of the center axis of latch 10, which also serves as a longitudinal axis for cordlock retention element 2. Ribs 11*a* and 11*b* include curved radially inner surfaces 15*a*, 5*b* facing towards the axis. Rib 11*a* is closer to rear end wall 12 than rib 11*b*. The deepest part of curved surface 15*a* of rib 11*a* is disposed further away from the longitudinal axis of latch 10 than is the surface of rib 11*b*, that is, radially inner surface 15*b* extends closer to the longitudinal axis than surface 15*a*. Rib 11*a* includes an overhanging portion extending towards the center axis. Rib 11*b* is supported at the front of a flat surface portion. Cylindrical pins 14 extend inwardly from the side surfaces of latch 10, forwardly of ribs 11*a* and 11*b*.

With further reference to FIGS. 4A–4D, upper latch 20 includes pivot pins 22 which extend into corresponding openings in housing 3 to allow latch 20 to pivot upwardly relative to lower latch 10. Pins 22 may be integral with the remainder of latch 20. Rear wall 28 of upper latch 20 includes semi-circular opening 28*a* disposed so as to correspond with opening 12*a* in lower latch 10 when upper latch 20 is in the lower position, to from a cord opening. Upper latch 20 further includes perpendicular or transverse plate 24 extending downwardly and having opening or cutout region 24*a*. Left and right side lateral plates 26 also extend downwardly from the upper surface of latch 20, along the sides of latch 20, and rearward of plate 24. Lateral plates 26 include lower circular openings, as well as a short separation segment extending upwardly from the openings. Latch 20 and plates 26 are made of a flexibly resilient material such that the segments allow the portions of plates 26 formed on either side of the circular opening to be pulled slightly apart to receive cylindrical pins 14 of lower latch 10 in the circular openings. When the pins are fully received, the portions come together in a snap-lock fit to retain pins 14. Upper front plate 32 extends downwardly on one side of latch 20, perpendicular to the longitudinal axis and near wall 28. Upper plate 32 rests upon the flat surface portion of rib 11*b* when latch 20 is-closed upon latch 10, and serves as a third offset rib.

With the exception of the above-enumerated elements, the interiors of lower latch 10 and upper latch 20 are generally hollow. When latch 20 is pivoted downwardly on top of latch 10, a generally empty cord retention space is defined therebetween. Electrical contact blades 13 extend rearwardly from an interior surface of housing 3 into the empty cord retention space. Blades 13 are linked to the motor in a conventional manner.

Polisher 1 may be powered by a conventional round extension cord 40 having plug 42. In order to attach cord 40, upper latch 20 is pivoted upwardly away from lower latch 10, and blades 13 are secured in the corresponding receptacles of plug 42. Plug 42 fits within the empty space defined between upper latch 20 and lower latch 10. Cord 40 is then threaded between offset ribs 11*b* and 11*a* and third rib 32. Inner curved surface 15*b* of rib 11*b* is not spaced far enough from the longitudinal axis to accommodate the entire diameter of cord 40 on one side of the longitudinal axis, that is, the inner surface forces cord 40 to bend towards the opposite side of latch 10. To the rear of rib 11*b*, cord 40 is forced laterally past curved surface 15*a* of rib 11*a*, that is, rib 11*a* allows cord 40 to bend back towards the longitudinal axis. Accordingly, the offset nature of ribs 11*a* and 11*b* causes cord 40 to assume a serpentine shape when threaded therethrough. The overhanging portion of rib 11*a* extends over cord 40. After passing rib 11*b*, cord 40 passes through semi-cylindrical opening 12*a* in wall 12.

Upper latch 20 is then pivoted downwardly to close lower latch 10 and thereby enclose plug 42 entirely within the open space of the cord lock retention mechanism. Upper latch 20 is secured to lower latch 10 by the snap-lock of lateral plates 26 about cylindrical pins 14. In Order to open the cordlock retention mechanism, upper latch 20 is simply pulled upwardly, and the flexibility of plates 26 allows the pins 14 to clear the openings.

When upper latch 20 is secured upon lower latch 10, transverse plate 24 is disposed just rearwardly of plug 42, with cord 40 passing through cutout 24*a* formed in plate 24. As described above, cord 40 passes between offset ribs 11*a* and 11*b* without interference from upper latch 20. Upper plate 32 in upper latch 20 is disposed upon the flat surface portion of rib 11*b* rearward of rib 11*a* and the projecting part of rib 11*b*, and receives cord 40 at a location just forward of where cord 40 exits polisher 1 through the circular opening formed by cooperation of openings 12*a* and 28*a*. Upper plate 32 acts has a third offset rib and ensures alignment of cord 40 with the circular opening so that cord 40 is not bent as it exits polisher 1.

Since plate 24 is disposed just behind plug 42, plate 24 ensures that plug 42 will stay connected to blades 13, even when cord 40 and plug 42 are subjected to a force which would tend to pull plug 42 off of blades 13. Thus, an undesirable power interruption is avoided. In addition, the serpentine bending in the cord provided by ribs 11*a* and 11*b* provides strain relief should the cord be pulled relative to polisher 1. Finally, the overhanging portion of rib 11*a* precludes the cord from looping upwardly within latch 20 and thus unintentionally raising upper latch 20.

Though the above invention was disclosed with reference to a random orbital automotive polisher, it is not limited to this type of apparatus. For example, the invention would be applicable to automotive polishers having other types of drives, for example, pure orbital or rotational drives. Alternatively, the invention is broadly applicable to other types of corded power tools such as sanders.

We claim:

1. A power tool comprising:

a housing:

first and second latches extending from said housing and disposed opposite each other, said first latch pivotably mounted to said housing relative to said second latch, said first latch pivotable between a closed position in which said first latch is in contact with said second latch to thereby form an enclosed space having a longitudinal axis and an open position in which said first latch is not in contact with said second latch, a cord opening formed when said first latch contacts the second latch;

a plurality of electrical contact blades extending from said housing and disposed within the enclosed space;

first and second offset ribs formed on and extending inwardly from one of said first and second latches in a spaced relationship along the longitudinal axis, said first rib having an inner surface which extends closer to the longitudinal axis than an inner surface of said second rib;

a transverse plate formed on and extending inwardly from one of said first and second latches and extending transversely to the longitudinal axis, said transverse plate disposed in a spaced relationship along the longitudinal axis with respect to said ribs, said transverse plate having a cutout region; wherein, a power cord having a plug may be disposed within the enclosed space with the contact blades disposed within the plug at one end of the plug and the opposite end of the plug disposed forwardly of said transverse plate, the cord passing through said cutout region and between said offset ribs whereby said ribs force the cord to bend in serpentine manner, the cord exiting the enclosed space through the cord opening.

2. The power tool recited in claim 1, said plate formed on said first latch, said ribs formed on said second latch, each said latch having an opening, said latch openings coming together to form said cord opening when said first latch is in the closed position.

3. The power tool recited in claim 2, one of said first and second latches comprising an upper latch and the other of said first and second latches comprising a lower latch.

4. The power tool recited in claim 3, said first latch comprising said upper latch and said second latch comprising said lower latch.

5. The power tool recited in claim 1, one of said first and second latches further comprising a parallel plate extending generally parallel to the longitudinal axis, said parallel plate including an opening partially dividing said plate into segments on opposite sides of said opening, said plate made from a resiliently flexible material; and the other of said first and second latches including a pin disposed so as to be received in said opening of said parallel plate when said first latch is moved to the closed position.

6. The power tool recited in claim 5, said parallel plate formed on said first latch and said pin formed on said second latch.

7. The power tool recited in claim 6, said first latch comprising two said parallel plates and said second latch comprising two said pins, each pin received in one parallel plate.

8. The power tool recited in claim 1, wherein, said power tool comprises a polisher, said polisher having a driven platen secured to and extending from said housing.

* * * * *